United States Patent [19]

Gaskell

[11] Patent Number: 4,549,696

[45] Date of Patent: Oct. 29, 1985

[54] FUEL INJECTION NOZZLES

[75] Inventor: David J. Gaskell, Upper Stanstead, England

[73] Assignee: Lucas Industries, p.l.c., Birmingham, England

[21] Appl. No.: 626,240

[22] Filed: Jun. 29, 1984

[30] Foreign Application Priority Data

Jul. 16, 1983 [GB] United Kingdom ..... 8319286

[51] Int. Cl.[4] ..... B05B 1/12; F02M 61/18

[52] U.S. Cl. ..... 239/452; 239/459; 239/533.4; 239/533.12

[58] Field of Search ..... 239/453, 459, 533.2–533.12, 239/452

[56] References Cited

U.S. PATENT DOCUMENTS 3,249,308 5/1966 Cadiou ..... 239/453

FOREIGN PATENT DOCUMENTS 506609 6/1939 United Kingdom ..... 239/533.2
804723 11/1958 United Kingdom ..... 239/453
2034405 6/1980 United Kingdom ..... 239/533.2

*Primary Examiner*—Andres Kashnikow
*Assistant Examiner*—Mary Beth O. Jones

[57] ABSTRACT

A fuel injection nozzle for supplying fuel to an internal combustion engine is of the so-called outwardly opening type and has a valve head located in a pocket the wall of which is of right cylindrical form. A circumferential groove is formed in the wall of the pocket and fuel is communicated thereto by a further groove or grooves on the valve head. The valve head forms a first outlet communicating with the circumferential groove and through which on the initial lift of the valve head fuel flows to produce a low penetration fuel spray. As the head is further lifted ports in the valve head are exposed to the groove and these ports communicate with a central outlet in the head. A penetrative jet of fuel issues from the central outlet.

3 Claims, 4 Drawing Figures

FUEL INJECTION NOZZLES

This invention relates to fuel injection nozzles for supplying fuel to an internal combustion engine, the nozzle being of the so-called outwardly opening type and comprising a hollow body part, a valve assembly including a resiliently loaded valve member and a seating, the valve assembly being located within the body part with a valve head forming part of the assembly being exposed at one end of the body part but being located in a pocket therein downstream of the seating and a fuel inlet communicating with the interior of the body part, the arrangement being such that in use when fuel under pressure is supplied to the inlet the fuel pressure acting upon the components of the valve assembly will effect movement of the valve head away from the seating to permit fuel flow into the associated combustion chamber of the associated engine.

The object of the present invention is to provide such a nozzle in a form in which the fuel spray produced is initially of low penetration but changes as the valve member moves towards its fully open position to one having an increased penetration.

According to the invention in a fuel injection nozzle of the kind specified said pocket has a right cylindrical wall and there is formed in said wall at a position spaced from its end remote from the seating, a circumferential groove, said valve head defining a first portion adjacent the contact region of the head with the seating, said first portion defining with the wall of the pocket a space to which fuel is supplied when the head is lifted from the seating, the valve head defining a second portion of right cylindrical form adjacent said first portion, said second portion having a working clearance with the wall of the pocket the valve head defining a third portion which defines with said wall of the pocket a first outlet, means for conveying fuel from said space to said groove, a second outlet formed in the valve head and passage means in said head connecting said second outlet to a control port formed in said second portion of the head, said control port being positioned so that the initial flow of fuel upon movement of the valve head away from the seating takes place from said groove through the first outlet to provide a fuel spray of low penetration, and as the valve head continues to move away from the seating, flow of fuel will take place from said groove through the control port and the second outlet to produce a spray pattern of increased penetration, the flow of fuel through said first outlet diminishing as the valve head moves to its fully opened position.

Figure 1:
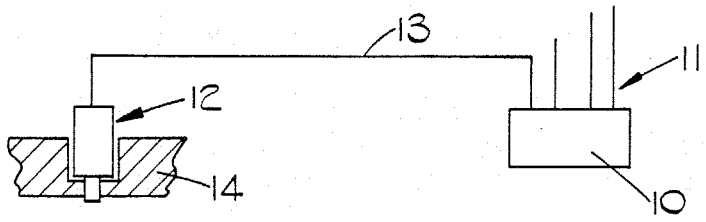
Figure 2:
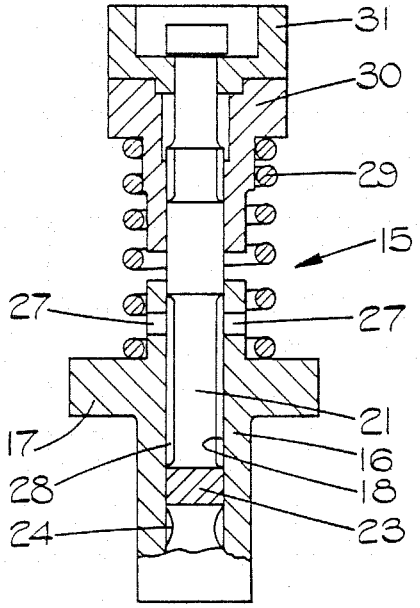
Figure 3:
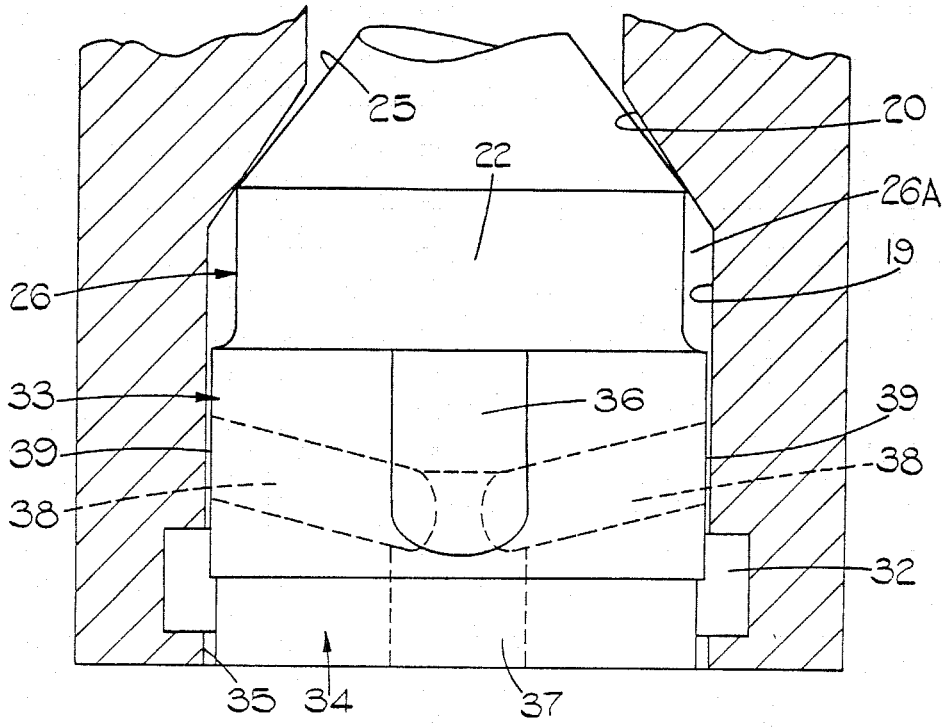
Figure 4:
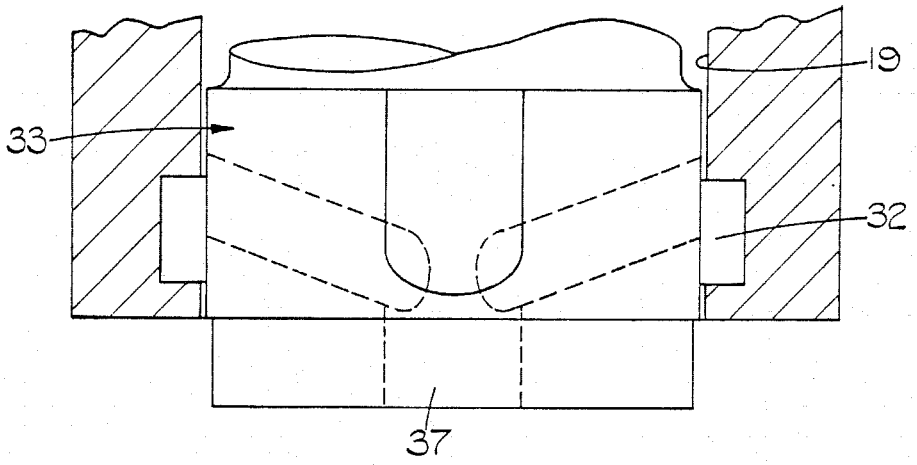

An example of a fuel injection nozzle in accordance with the the invention will now be described with reference to the accompanying drawings in which:

FIG. 1 shows a diagram of a fuel system incorporating a nozzle in accordance with the invention, FIG. 2 shows to an enlarged scale, the main portion of the valve assembly of the nozzle, FIG. 3 shows to a further enlarged scale a portion of the valve assembly not seen in FIG. 2 in the closed position of the nozzle, and FIG. 4 is a view similar to FIG. 3 showing the valve assembly in the fully opened position.

Referring to FIG. 1 of the drawings, an engine fuel system includes a pump 10 which in use is driven in timed relationship with the associated engine. The pump is provided with a plurality of outlets indicated at 11 and each of these outlets is connected to a respective injection nozzle one of which is indicated at 12, by means of a fuel supply line 13. The nozzle 12 in use is located within a bore formed in the cylinder head 14 of the engine so that the inner end of the nozzle projects into a combustion space on the engine.

The nozzle 12 comprises a hollow body not shown in which is mounted a valve assembly generally indicated at 15 in FIG. 2. The valve assembly includes a tubular member 16 having a flange 17 which in use forms an end closure for the hollow body of the nozzle. The tubular member has an internal bore 18 which at its lower end extends into a pocket 19 (FIGS. 3 and 4) of larger diameter than the bore and intermediate the pocket and the wall of the bore 18 is formed an inclined seating 20. The wall of the pocket 19 is of right cylindrical form.

Slidable within the bore is a valve member 21 having at its end adjacent the seating a head 22 which in the closed position of the valve member as shown in FIG. 3, is located within the pocket 19. In the closed position the head co-operates with the seating 20. The valve member is guided within the bore 18 by a helically fluted portion 23 and intermediate the fluted portion 23 and the head 22 the valve member is provided with a recessed portion 24 which tapers outwardly and joins a first cylindrical portion 26 of the valve head 22 having a diameter which is smaller than the diameter of the wall of the pocket 19. The recessed portion 24 defines a surface 25 which in the closed position engages with the seating 20. Moreover, intermediate the portion 24 and the wall of the pocket is defined a space 26A.

The tubular member 16 is provided with a pair of ports 27 which communicate at all times with an annular clearance 28 defined between the valve member 21 and the wall of the bore 18. The valve member extends from the tubular member and a portion of the valve member lying within the tubular member has the same diameter as the bore 18 in order to guide the movement of the valve member.

The valve member is biased towards the closed position by means of a coiled compression spring 29 one end of which engages the flange 17 and the other end of which engages a spring abutment 30 mounted about the valve member and retained thereon by means of a retaining member 31.

In the wall of the pocket 19 adjacent the end thereof removed from the seating, is a circumferential groove 32. The valve head is provided with a second portion 33 which is of right cylindrical form and which has a working clearance with the the wall of the pocket, the size of the working clearance being such that leakage of fuel therealong is at a minimum whilst still allowing the valve head to move. In addition, the valve head is provided with a third portion 34 again of right cylindrical form but having a diameter which is smaller than the diameter of the pocket. The portion 33 and the wall of the pocket define a first outlet 35 which is of annular form and which communicates with the groove 32. The portion 34 of the valve head in the closed position of the valve member extends over roughly half the axial length of the groove 32.

The groove 32 is in communication with the space 26A defined between the wall of the pocket and the portion 26 of the valve head by way of a groove 36 which is formed on the second portion 33 of the valve member and which extends towards the third portion of the valve member but terminates short thereof. There may be more than one groove 36.

The valve member also defines a second outlet and this is in the form of a blind drilling 37 which extends from the free end of the valve member and which communicates by way of passages 38, with control ports 39 which open onto the second portion 33 of the valve member but which in the closed position thereof, are obturated.

In use, when fuel under pressure is supplied to the aforesaid inlet, the pressure of fuel generates a force on the valve member tending to move the valve member outwardly against the action of the spring 29. As soon as the valve head is lifted from the seating, fuel flow can take place into the space 26A and from this space by way of the groove or grooves 36, to the circumferential groove 32. From the latter groove the fuel can flow to the outlet 35 and a fuel spray is developed which is of a "bushy" nature having a low penetrative power.

The initial bushy nature of the spray ensures a short delay period between the start of injection of fuel and the start of combustion and this reduces engine noise.

No flow of fuel will take place through the outlet 37 until the valve head has moved a distance such that the control ports 39 are exposed to the groove 32. When this takes place fuel starts to flow through the passages 38 and from the central outlet 37 and this produces a fuel spray which is of jet-like form and having an increased penetrative power. As the valve head continues to move towards its fully open position, the area of the control ports exposed to the groove 32 increase and the second portion 33 of the valve head starts to close off the outlet 35, this outlet being completely closed shortly before the valve member reaches its fully open position as shown in FIG. 4. In the fully open position all the fuel flow takes place through the outlet 37.

I claim:

1. A fuel injection nozzle for supplying fuel to an internal combustion engine, the nozzle being of the so-called outwardly opening type and comprising a hollow body part, a valve assembly including a resiliently loaded valve member and a seating, the valve assembly being located within the body part with a valve head forming part of the assembly being exposed at one end of the body part but being located in a pocket therein downstream of the seating and a fuel inlet communicating with the interior of the body part, said pocket having a right cylindrical wall, a circumferential groove formed in said wall at a position spaced from the end of the wall remote from the seating, said valve head defining a first portion adjacent the contact region of the head with the seating, said first portion defining with the wall of the pocket a space to which fuel is supplied when the head is lifted from the seating, the valve head defining a second portion of right cylindrical form adjacent said first portion, said second portion having a working clearance with the wall of the pocket, the valve head defining a third portion which defines with said wall of the pocket a first outlet, means for conveying fuel from said space to said groove, a second outlet formed in the valve head and passage means in said head connecting said second outlet to a control port formed in said second portion of the head, said control port being positioned so that the initial flow of fuel upon movement of the valve head away from the seating takes place from said groove through the first outlet to provide a fuel spray of low penetration, and as the valve head continues to move away from the seating, flow of fuel will take place from said groove through the control port and the second outlet to produce a spray pattern of increased penetration, the flow of fuel through said first outlet diminishing as the valve head moves to its fully opened position.

2. A nozzle according to claim 1 in which the means for conveying fuel from said space to the groove comprises a further groove or grooves formed on the peripheral surface of said second portion of the valve head, said further groove or grooves extend from the end of said second portion adjacent said first portion to adjacent the opposite end thereof.

3. A nozzle according to claim 1 in which said first outlet is of annular form.

* * * * *